US007628196B2

(12) United States Patent
Yamane et al.

(10) Patent No.: US 7,628,196 B2
(45) Date of Patent: Dec. 8, 2009

(54) METHOD AND APPARATUS FOR CONTINUOUS CASTING OF METALS

(75) Inventors: Hiroshi Yamane, Chiba (JP); Nagayasu Bessho, Tokyo (JP); Yuji Miki, Okayama (JP); Shuji Takeuchi, Chiba (JP); Tadasu Kirihara, Okayama (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 10/766,910

(22) Filed: Jan. 30, 2004

(65) Prior Publication Data

US 2004/0182539 A1 Sep. 23, 2004

Related U.S. Application Data

(62) Division of application No. 09/714,161, filed on Nov. 17, 2000, now Pat. No. 6,712,124.

(30) Foreign Application Priority Data

Jul. 10, 2000 (JP) ..... 2000-207972
Jul. 10, 2000 (JP) ..... 2000-207973

(51) Int. Cl.
*B22D 11/00* (2006.01)
*B22D 27/02* (2006.01)

(52) U.S. Cl. ..... 164/502; 164/466

(58) Field of Classification Search ..... 164/466, 164/502

See application file for complete search history.

(56) References Cited

U.S. PATENT DOCUMENTS 4,016,926 A * 4/1977 Yamada et al. ..... 164/504
4,905,756 A 3/1990 Lari et al.

(Continued)

FOREIGN PATENT DOCUMENTS

DE 35 17 733 11/1986

(Continued)

OTHER PUBLICATIONS

Fujisaki et al., "Fundamental Electromagnetic Characteristics of In-Mold Electromagnetic Stirring in Continuous Casting", International Symposium on Electromagnetic Processing of Materials, Nagoya, ISIJ, pp. 272-277, 1994.

*Primary Examiner*—Kevin P Kerns
(74) *Attorney, Agent, or Firm*—Young & Thompson

(57) ABSTRACT

During continuous casting of metals, a non-moving, vibrating magnetic field is applied to a molten metal in a casting mold to impose only vibration on the molten metal. This continuous casting method can produce a cast slab much less susceptible to flux entrainment, capture of bubbles and non-metal inclusions near the surface of the molten metal, and surface segregation. The magnetic field is preferably produced by arranging electromagnets in an opposing relation on both sides of the mold to lie side by side in the direction of longitudinal width of the mold, and supplying a single-phase AC current to each coil. The single-phase AC current preferably has frequency of 0.10 to 60 Hz. A static magnetic field can be applied intermittently in the direction of thickness of a cast slab. This technique can produce a cast slab substantially free from the flux entrainment and the surface segregation. Preferably, the static magnetic field is intermittently applied under setting of an on-time t1=0.10 to 30 seconds and an off-time t0=0.10 to 30 seconds. Also, the static magnetic field is preferably applied to the surface of the molten metal.

2 Claims, 12 Drawing Sheets

U.S. PATENT DOCUMENTS

| | | | |
|---|---|---|---|
| 5,746,268 | A | 5/1998 | Fujisaki et al. |
| 6,044,858 | A | 4/2000 | Natheson |
| 6,164,365 | A | 12/2000 | Kunstreich et al. |
| 6,321,766 | B1 | 11/2001 | Natheson |

FOREIGN PATENT DOCUMENTS

| | | | |
|---|---|---|---|
| EP | 0 754 515 | | 1/1997 |
| EP | 0 972 591 | | 1/2000 |
| JP | 2-274350 | | 11/1990 |
| JP | 4-100665 | | 4/1992 |
| JP | 5-154623 | | 6/1993 |
| JP | 5-293613 | | 11/1993 |
| JP | 6-182518 | | 7/1994 |
| JP | 6-182518 | A * | 7/1994 |
| JP | 6-190520 | | 7/1994 |
| JP | 8-19840 | | 1/1996 |
| JP | 8-90169 | | 4/1996 |
| JP | 08155605 | | 6/1996 |
| JP | 08187563 | | 7/1996 |
| JP | 08267197 | | 10/1996 |
| JP | 9-262650 | | 7/1997 |
| JP | 9-262651 | | 7/1997 |
| JP | 09182941 | | 7/1997 |
| JP | 9-239505 | | 9/1997 |
| JP | 10-305353 | | 11/1998 |
| JP | 3056656 | | 4/2000 |
| JP | 2000-271710 | | 10/2000 |

* cited by examiner

METHOD AND APPARATUS FOR CONTINUOUS CASTING OF METALS

This application is a division of application Ser. No. 09/714,161, filed on Nov. 17, 2000, and issued as U.S. Pat. No. 6,712,124, the entire contents of which are hereby incorporated by reference.

BACKGROUND OF THE INVENTION

1. Field of the Invention

The present invention relates to a continuous casting method and apparatus for effecting flow control of molten steel using a magnetic field during continuous casting of steel.

2. Description of Related Art

In continuous casting, an immersion nozzle is often used to pour a molten metal into a casting mold. If the flow speed of the surface molten metal is too high at that time, mold flux on the surface of the molten metal is entrained (or involved) into a body of the molten metal, and if the flow speed of the surface molten metal is too low, the molten metal stagnates and segregates there, thus finally giving rise to surface segregation. For reducing such surface defects, there is known a method of applying a static magnetic field and/or a moving magnetic field (AC moving magnetic field) to the molten metal in the mold for controlling the flow speed of the molten metal.

However, the known method has problems as follows. When a static magnetic field is applied to brake a flow of the molten metal (for electromagnetic braking), segregation tends to occur readily, particularly in a position where the molten metal stagnates. Also, when a moving magnetic field is applied to agitate the molten metal (for electromagnetic agitation), entrainment of the mold flux (flux entrainment) tends to occur readily in a position where the flow speed of the molten metal is high.

To cope with the above problems, several proposals have been made as to the manner of applying a magnetic field. For example, Japanese Unexamined Patent Application Publication No. 9-182941 discloses a method of periodically reversing the direction, in which a molten metal is agitated by a moving magnetic field, to prevent inclusions from diffusing downward from an agitation area. Japanese Unexamined Patent Application Publication No. 8-187563 discloses a method of preventing a breakout by changing the magnitude of a high-frequency electromagnetic force depending on vibration of a casting mold. Japanese Unexamined Patent Application Publication No. 8-267197 discloses a method of preventing inclusion defects by providing a gradient to a change rate of the magnetic flux density in the changeover process of an electromagnetic braking force so as to reduce changes of a molten metal flow. Furthermore, Japanese Unexamined Patent Application Publication No. 8-155605 discloses a method of applying a horizontally moving magnetic field at frequency of 10-1000 Hz through conductive layers, each of which has low electrical conductivity and is formed to extend continuously in the direction of transverse width of a casting mold, and imposing a pinching force on a molten metal so that a contact pressure between the casting mold and the molten metal is reduced.

However, none of these known methods has succeeded in satisfactorily preventing the occurrence of flux entrainment, because a macro flow of the molten metal is caused due to the moving magnetic field, or because the flow speed of the molten metal is increased in a position where the static magnetic field is small.

SUMMARY OF THE INVENTION

With the view of breaking through the limits of the related art set forth above, it is an object of the present invention to provide a continuous casting method and apparatus for metals, which can produce a cast slab much less susceptible to flux entrainment, capture of bubbles and non-metal inclusions near the surface of a molten metal, and surface segregation.

As a result of conducting intensive studies, the inventors have made the following findings.

Aspect A of Invention: Application of Non-moving, Vibrating AC Magnetic Field

1) Molten-metal flow control under application of a static magnetic field is very effective in preventing entrainment of mold flux 3 and occurence of inclusions. However, if the magnetic field is too strong, the flow speed of a molten metal is reduced and surface segregation 5 is caused due to semi-solidification at the surface of the molten metal. (See FIG. 1)
2) Molten-metal flow control under application of a moving magnetic field is able to prevent the surface segregation 5 and capture of foreign matters (bubbles and non-metal inclusions 4) at the solidification interface. With a resulting increase of the flow speed of the molten metal indicated by 2, however, the entrainment of the mold flux 3 is more likely to occur and an amount of the entrained mold flux 3 is apt to increase. (See FIG. 1)
3) A method of applying an electromagnetic force, which induces only vibration without inducing a macro flow, so as to act upon the molten metal is very effective in preventing the semi-solidification at the surface of the molten metal and the capture of foreign matters at the solidification interface while holding down the flux entrainment. Such an electromagnetic force can be produced by an AC magnetic field which is not moved but only vibrated (hereinafter referred to as a "non-moving, vibrating magnetic field)." Thus, the term "non-moving magnetic field" as used herein connotes magnetic flux alternating in opposite directions, whereas a moving magnetic field connotes a magnetic flux continuing in a single direction.

The present invention according to this aspect A has been accomplished based on the above-mentioned findings.

More particularly, according to this aspect A of the present invention, there is provided a continuous casting method for metals, the method comprising the step of applying a non-moving, vibrating magnetic field to a molten metal in a casting mold to impose only vibration on the molten metal.

The non-moving, vibrating magnetic field is preferably produced by arranging electromagnets, each of which comprises an iron core and a coil wound over the iron core, in an opposing relation on both sides of the mold in the direction of transverse width thereof to lie side by side in the direction of longitudinal width of the mold, and supplying a single-phase AC current to each coil.

The iron core may comprise individual single iron cores separate from each other, or a comb-shaped iron core having a comb-teeth portion over which coils are wound.

The single-phase AC current preferably has frequency of 0.10 to 60 Hz.

Furthermore, a DC magnetic field and an AC magnetic field for producing the non-moving, vibrating magnetic field may be applied in superimposed fashion in the direction of transverse width of the mold.

Aspect B of Invention: Intermittent Application of Static Magnetic Field

1) Molten-metal flow control under application of a static magnetic field is very effective in preventing entrainment of mold flux and intrusion of inclusions. However, if the magnetic field is too strong, the flow speed of a molten metal is reduced and segregation is caused due to solidification at the surface of the molten metal, as shown on the left side of FIG. 6.
2) With molten-metal flow control under application of a moving magnetic field, the flow speed of the molten metal is increased and the flux entrainment is more likely to occur, as shown on the right side of FIG. 6.

In other words, when an area appears in which the molten metal slows down its flow speed and is semi-solidified, segregation occurs in that area and product defects are ultimately caused. Providing a macro flow to the molten metal to avoid the occurrence of segregation, however, promotes the flux entrainment and gives rise to new defects.

3) A method of applying a static magnetic field intermittently is very effective in preventing the semi-solidification at the surface of the molten metal while holding down the flux entrainment.

According to this aspect B of the present invention, there is provided a continuous casting method for casting a metal while applying a static magnetic field in the direction of thickness of a cast slab, comprising the step of intermittently applying the static magnetic field. Herein, the term "intermittent application" means a process of alternately repeating application (on) of the static magnetic field and no application (off) of the static magnetic field.

Preferably, the static magnetic field is intermittently applied under setting of an on-time t1=0.10 to 30 seconds and an off-time t0=0.10 to 30 seconds. Also, the static magnetic field is preferably applied to a surface of a molten metal. It is more preferable to employ setting of an on-time t1=0.3 to 30 seconds and an off-time t0=0.3 to 30 seconds.

According to another aspect of the present invention, when continuous casting is performed by applying a DC magnetic field and an AC magnetic field in superimposed fashion in the direction of transverse width of a casting mold at positions above and below an ejection port of an immersion nozzle immersed in a molten metal in the mold, the AC magnetic field may be moved in a longitudinally symmetrical relation from both ends to the center of the mold in the direction of longitudinal width thereof.

The above method can be implemented by a continuous casting apparatus for molten metals, the apparatus comprising a coil for producing an AC magnetic field moving in a longitudinally symmetrical relation from both ends to the center of the mold in the direction of longitudinal width thereof, and a coil for producing a DC magnetic field, both the coils being wound over each of common iron cores, the iron cores being arranged on both sides of the mold in the direction of transverse width thereof such that a direction of the magnetic fields produced by the coils is aligned with the direction of transverse width of the mold.

BRIEF DESCRIPTION OF THE DRAWINGS

FIGS. 9A and 9B show one example of an apparatus according to the present invention, wherein FIG. 9A is a schematic sectional plan view and FIG. 9B is a schematic sectional side view;

FIGS. 17A and 17B show another example of an apparatus according to the present invention, wherein FIG. 17A is a schematic sectional plan view and FIG. 17B is a schematic sectional side view.

Figure 1:
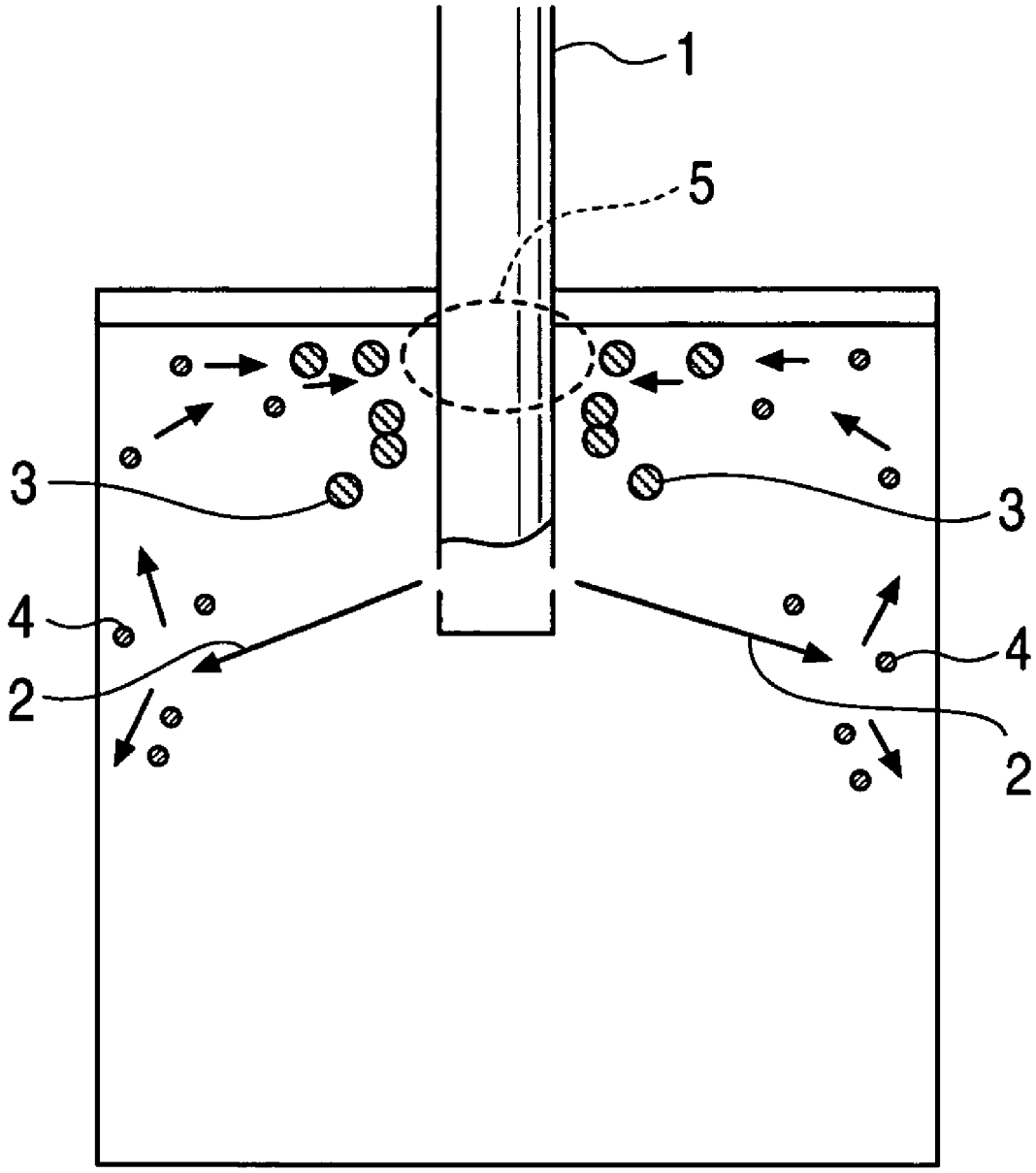
FIG. 1 is a schematic view for explaining mechanisms that generate flux entrainment, surface segregation, and capture of foreign matters.

In the figures, the following reference numerals designate the following components and features:

1. Immersion nozzle
2. Flow speed of the molten metal
3. Mold flux
4. Non-metal inclusions
5. Surface segregation
6. Casting mold
7. Electromagnet
8. Iron core
9. Coil
10. Longitudinal width vibrating flow
11. Transverse width vibrating flow
12. Bulk current
13. Comb-shaped iron core
14. Comb teeth portion
15. Molten surface
16. Electromagnetic coil
17. Solidified shell
18. DC supplied coils

19. AC supplied coils
20. Direction of the DC magnetic field
21. Direction of the AC magnetic field
22. Magnetic poles
23. Molten steel
24. Electromagnetic force
25. Molten steel flow
26. Non-directional molten steel flow
27. Circulating flow
28. Ejected-and-reversed surfacing flow
29. Vortex
30. Stagnation
31. Moving AC magnetic field
32. AC/DC electromagnet
33. Immersion nozzle spout
34. DC electromagnet

DETAILED DESCRIPTION OF PREFERRED EMBODIMENTS

Aspect A of Invention: "Application of Non-Moving, Vibrating AC Magnetic Field"

With the aspect A of the present invention, a non-moving, vibrating magnetic field is applied to a molten metal in a casting mold under continuous casting to impose only vibration on the molten metal. Because of applying a non-moving magnetic field, a bulk flow (macro flow) of the molten metal is not produced, unlike in the case of applying a moving magnetic field, and therefore flux entrainment does not readily occur. Also, because of applying a vibrating magnetic field, minute vibration of the molten metal is generated in the vicinity of the solidification interface. The generated minute vibration contributes to not only preventing capture of foreign matter (bubbles and non-metal inclusions) by the solidification interface, but also holding down uneven solidification in the vicinity of a meniscus area (the surface of the molten steel) which is responsible for surface segregation.

Figure 2:
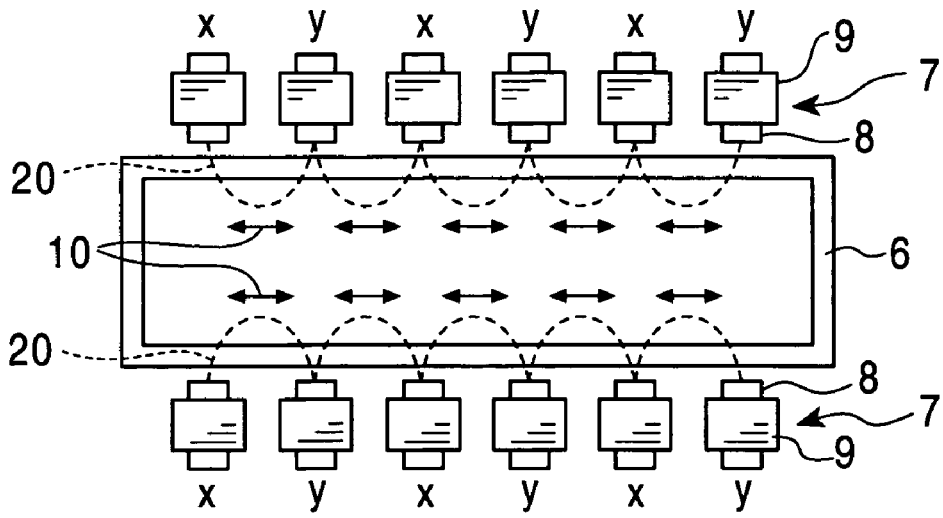
FIG. 2 is a schematic view showing a first example of a manner of creating a non-moving, vibrating magnetic field.
Figure 3:
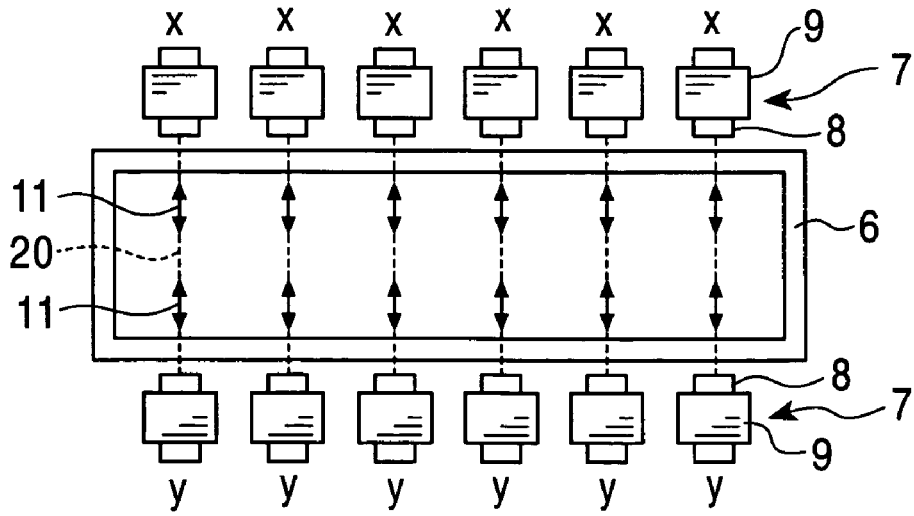
FIG. 3 is a schematic view showing a second example of the manner of creating the non-moving, vibrating magnetic field.

The non-moving, vibrating magnetic field can be created, by way of example, as shown in FIGS. 2 and 3. A number of electromagnets 7, each comprising an iron core 8 and a coil 9 wound around the iron core 8, are arranged on both sides of a casting mold 6 in an opposing relation in the direction of transverse width of the mold to lie side by side in the direction of longitudinal width of the mold, and a single-phase AC current is supplied to each coil 9. Note that numeral 20 in FIGS. 2 and 3 denotes a magnetic force line.

In a first example shown in FIG. 2, each pair of opposing coils 9, 9 are wound in the same direction (x, x or y, y), and pair of adjacent coils 9, 9 on the same side of the mold are wound in opposite directions (x, y). A single-phase AC current is then supplied to each of the coils 9 thus wound. Therefore, magnetic forces developed between every two electromagnets 7, 7 arranged adjacent to each other on the same side are reversed in direction repeatedly over time. As a result, only vibrating flows 10 in the direction of longitudinal width of the mold are induced in the molten metal and no bulk flows are produced.

In a second example shown in FIG. 3, each pair of opposing coils 9, 9 are wound in opposite directions (x, y), and pair of adjacent coils 9, 9 on the same side are wound in the same direction (x, x or y, y). A single-phase AC current is then supplied to each of the coils 9 thus wound. Therefore, magnetic forces developed between every two opposing electromagnets 7, 7 are reversed in direction repeatedly over time. As a result, only vibrating flows 11 in the direction of transverse width of the mold are induced in the molten metal and no bulk flows are produced.

Figure 4:
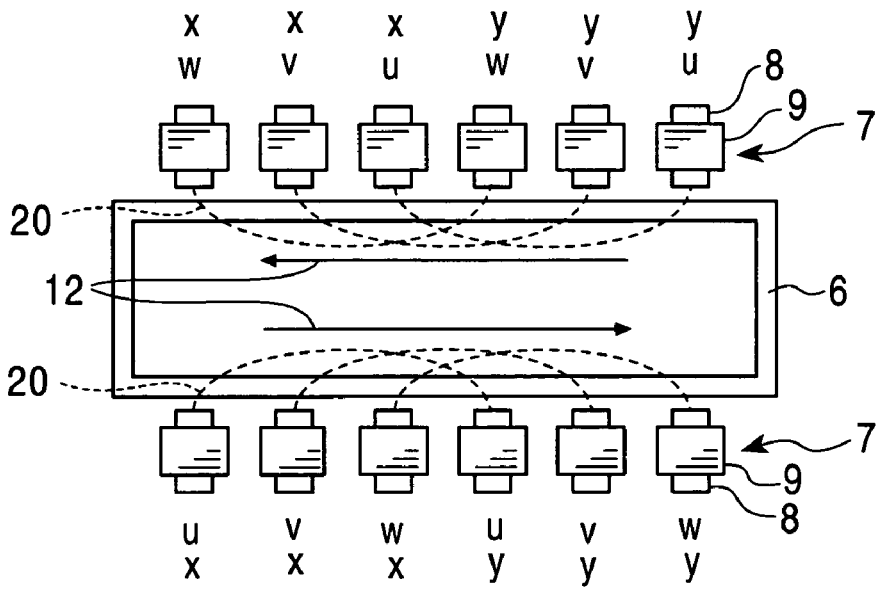
FIG. 4 is a schematic view showing one example of a manner of creating a moving magnetic field.

On the other hand, a moving magnetic field is created, by way of example, as shown in FIG. 4. A number of electromagnets 7, each comprising an iron core 8 and a coil 9 wound over the iron core 8, are arranged on both sides of a casting mold 6 in an opposing relation in the direction of transverse width of the mold to lie side by side in the direction of longitudinal width of the mold, and a three-phase AC current is supplied to each coil 9. Note that letters u, v and w denote different three phases of the three-phase AC current. The left six coils and right six coils are wound in opposite directions (x, y). With the moving magnetic field thus created, magnetic forces are produced in a constant direction (i.e., a direction from one end toward the other end of the mold along the longitudinal width thereof). Accordingly, a bulk current 12 is produced in the molten metal to horizontally circulate along inner walls of the mold 6, and it is difficult to hold down the occurrence of flux entrainment.

Figure 5:
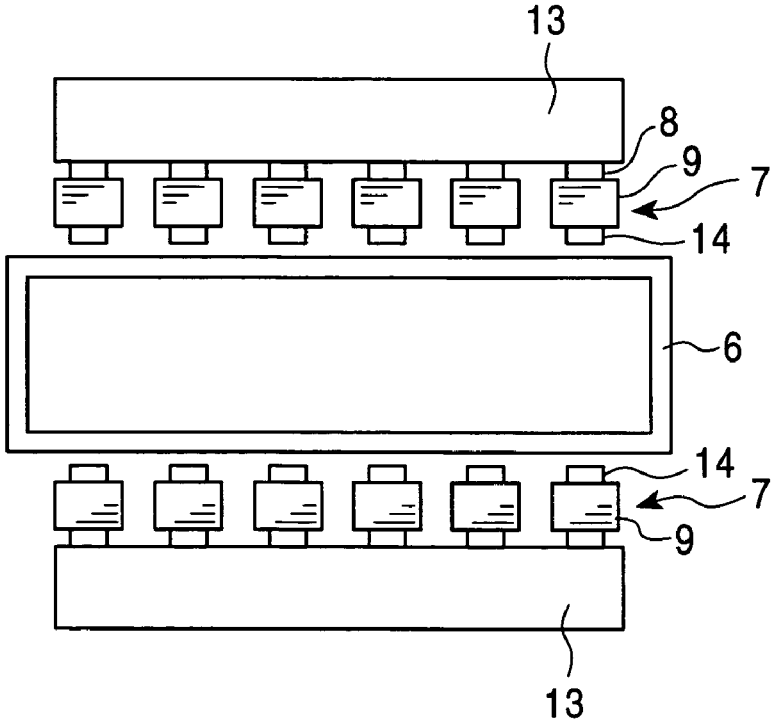
FIG. 5 is a schematic view showing one example of a comb-shaped iron core.
Figure 6:
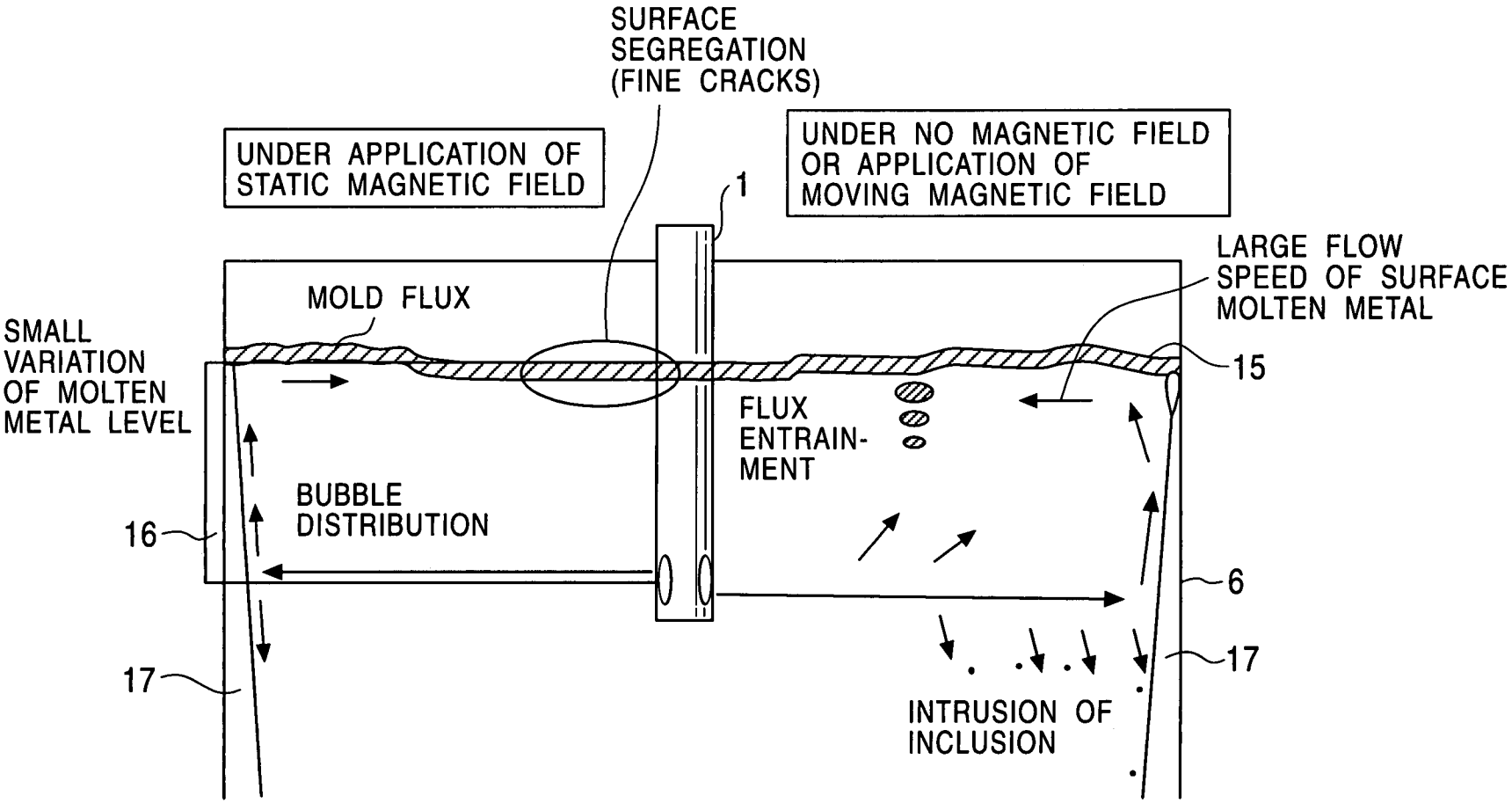
FIG. 6 is a schematic view for explaining mechanisms that generate flux entrainment and surface segregation.

While the iron cores of the electromagnets are constructed as individual single iron cores separate from each other in FIGS. 2 and 3, this aspect of the present invention may also implemented by using a comb-shaped iron core 13 as shown in FIG. 5 having comb teeth portions 14 over which the coils 9 are fitted. This construction is advantageous in that fabrication of the electromagnets is facilitated because the electromagnets can be fabricated by providing one comb-shaped iron core 13 on each side of the casting mold 6 in the direction of transverse width of the mold and fitting the coils 9 over the comb teeth portions 14 in a one-to-one relation.

Also, in this aspect of the present invention, the single-phase AC current supplied to the coils 9 preferably has frequency of 0.10-60 Hz. Setting the frequency to be not lower than 0.10 Hz makes it possible to increase the skin effect, to concentrate the vibration in the vicinity of the solidification interface, and to enhance the effect of preventing the capture of foreign matter. However, if the frequency exceeds 60 Hz, a vibration urging force is reduced down to a level close to viscosity resistance of the molten metal, whereby vibration of the molten metal is weakened and the effect of preventing the capture of foreign matter is lessened.

According to this aspect of the present invention, as described above, casting of a high-quality metal slab can be achieved which is free from surface segregation, contains less foreign matter (bubbles and non-metal inclusions) captured in the cast slab, and suffers from less flux entrainment.

The electromagnets are preferably disposed in positions close to the surface of the molten metal, but similar advantages can also be obtained even when the electromagnets are disposed in positions lower than the nozzle ejection hole.

EXAMPLES (Tables 1 and 2)

About 300 tons of ultra low carbon-and-Al killed steel (having a typical chemical composition listed in Table 1) was smelted using the converter—RH process, and a slab being 1500-1700 mm wide and 220 mm thick was cast by pouring the molten killed steel into a casting mold at a rate of 4-5 ton/min from an immersion nozzle with a continuous casting machine. In this slab casting step, experiments were conducted by arranging electromagnets in each of the layouts shown in FIGS. 2 to 4 at a level corresponding to the position of the molten steel surface, and supplying a three- or single-phase AC current of various frequencies to a coil of each electromagnet, thereby applying a moving magnetic field or a non-moving, vibrating magnetic field with a magnetic flux density of 0.1 T, or applying no magnetic field.

In the experiments, three characteristics, i.e., surface segregation, flux-based surface defects, and a bubble/-inclusion amount, were measured for each condition of applying the magnetic field in accordance with the following procedures.

Surface Segregation: After grinding the cast slab, the slab was subjected to etching and the number of segregates per 1 $m^2$ was counted by visual observation.

Flux-based Surface Defects: Surface defects in a coil obtained after cold rolling of the cast slab were visually observed, and after picking a defective sample, the number of defects caused by entrainment of mold flux was counted by analyzing the defects.

Bubble/Inclusion Amount: Non-metal inclusions were extracted by the slime extracting process from a portion of the cast slab at a position corresponding to a ¼ thickness thereof, and the weight of the extracted inclusions was measured (the number of bubbles was measured by slicing a surface layer of the cast slab and counting the number of bubbles observed with a transmitted X ray).

The experimental results are listed in Table 2 along with the conditions of applying the magnetic field. Note that evaluation values of the above three items are each represented in terms of an index (numerical value obtained by multiplying a ratio of the measured data to the worst data among all the conditions by 10).

As seen from Table 2, in Examples according to this aspect of the present invention in which the non-moving, vibrating magnetic field was applied, the surface segregation, the defects caused by the flux entrainment, and the amount of bubbles and non-metal inclusions could be all remarkably reduced.

In Example 1, since the frequency was too low, i.e., 0.05 Hz, a macro flow was partly induced in the molten steel and the flux-based surface defects were increased to some extent. Also, in Example 8, since the frequency was too high, i.e., 65 Hz, the vibration was weakened and the number of bubbles and inclusions was increased to some extent.

A description will now be made of a modification of this aspect of the present invention in which a DC magnetic field and an AC magnetic field for producing a non-moving, vibrating magnetic field are applied in superimposed fashion in the direction of transverse width of a casting mold.

Figure 9A:
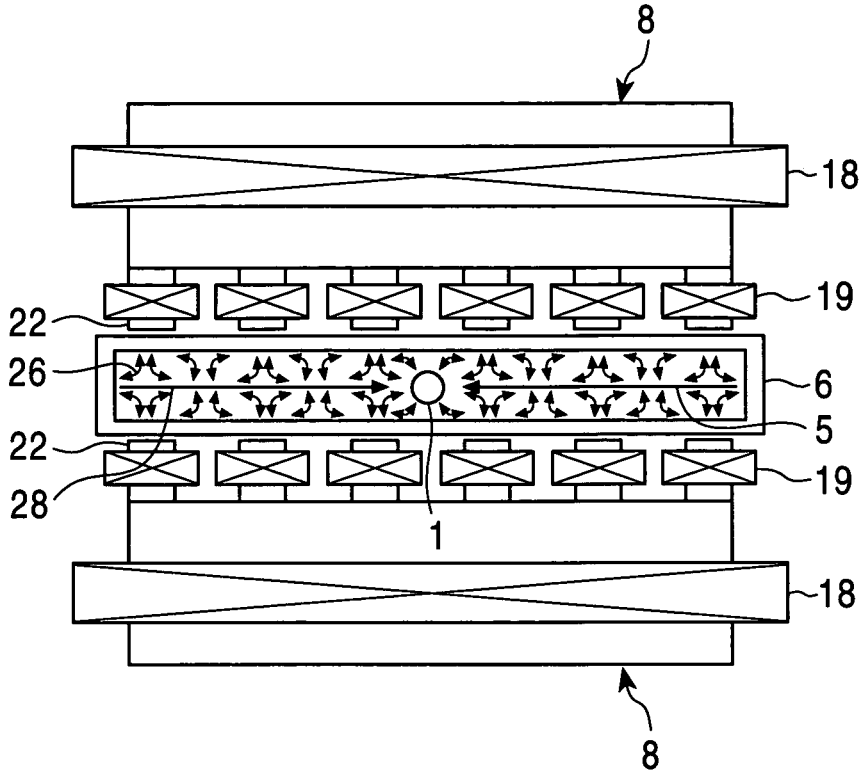
Figure 9B:
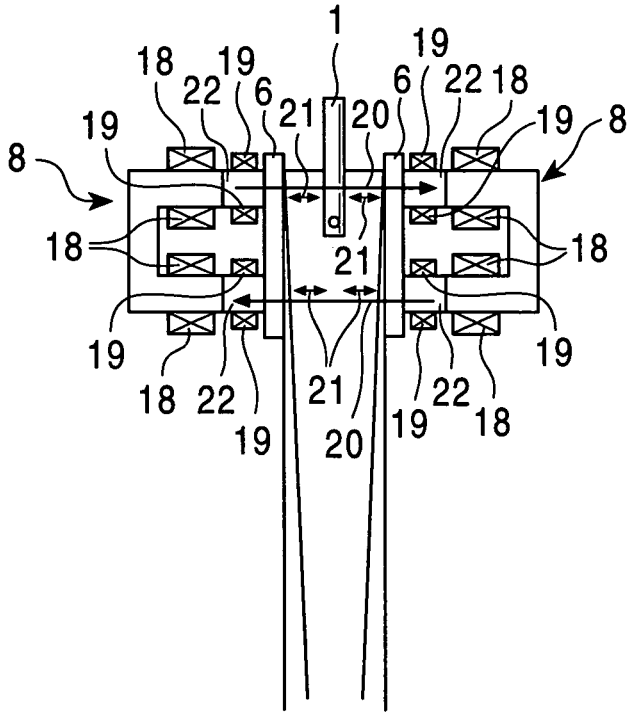

In FIGS. 9A and 9B, coils (DC supplied coils) 18, to which a DC current is supplied to produce DC magnetic fields (equivalent to static magnetic fields), and coils (AC supplied coils) 19, to which an AC current is supplied to produce fixed AC magnetic fields, are wound over a common iron core 8 as shown. Two iron cores 8 are disposed to extend respectively along outer surfaces of long sides of a casting mold 6 such that directions of the magnetic fields (i.e., directions 20 of the DC magnetic fields and directions 21 of the AC magnetic fields) are aligned with the direction of transverse width of the mold, and one or more (six on each of the upper and lower sides in the illustrated apparatus) pairs of magnetic poles 22 are positioned to face each other above and below an ejection port of an immersion nozzle 1. A single- or three-phase AC current is supplied to each of the AC supplied coils 19 which are arranged to lie side by side in the direction of longitudinal width of the casting mold 6.

In the magnetic field produced by the single-phase AC current, the phase of a waveform representing an intensity distribution in the direction of longitudinal width of the mold (positions of hills and valleys of the distribution) is not changed over time (that is to say, a wave does not move in the direction of longitudinal width of the mold). On the other hand, the so-called conventionally employed moving magnetic field is produced by arranging AC supplied coils in division to three sets and supplying three-phase AC currents to the three sets of coils with different phases from each other. In a magnetic field thus produced, the phase of a waveform representing an intensity distribution in the direction of longitudinal width of the mold is changed over time. Thus, the fixed AC magnetic field employed in the present invention means an AC magnetic field in which a wave does not move in a certain direction, unlike the conventionally employed moving magnetic field (moving AC magnetic field). Even with the use of a multi-phase AC current, it is also possible to produce an AC magnetic field, in which a wave does not move in a certain direction, by arranging the coils in a proper layout.

Figure 10:
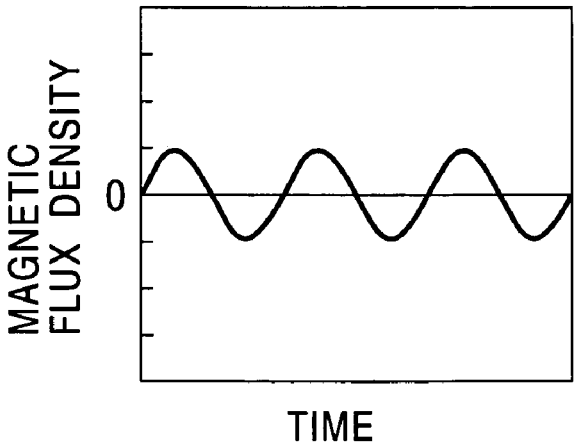
FIG. 10 is a waveform chart showing one example of a magnetic flux density produced under application of an AC magnetic field alone.
Figure 11:
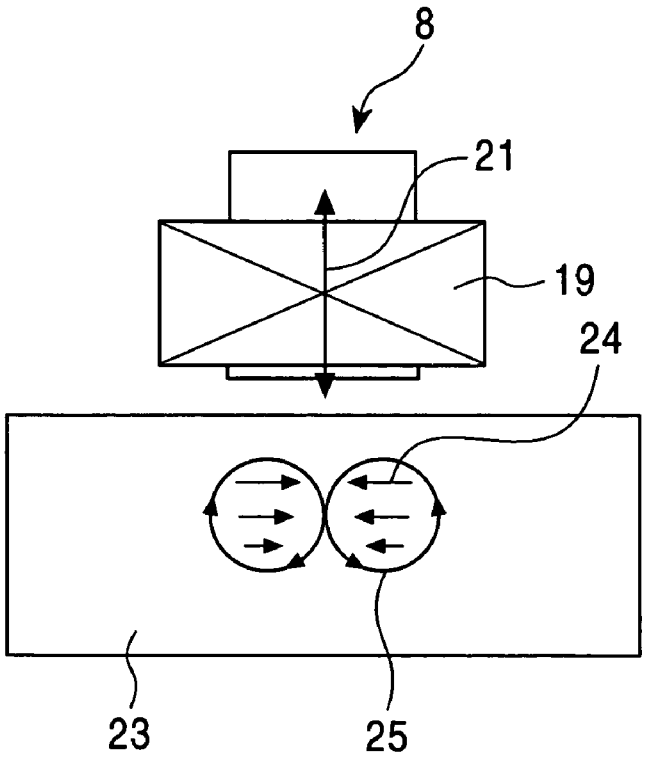
FIG. 11 is a schematic view for explaining molten steel flows occurring under application of an AC magnetic field alone.

As shown in FIG. 11, when a single AC magnetic field providing a magnetic flux density as represented by a waveform shown in FIG. 10, by way of example, is applied by the AC supplied coil 19 in the direction of transverse width of the mold (the direction 21 of the AC magnetic field), an electromagnetic force (pinching force) 24 with a magnitude varying periodically acts upon a molten steel 23 and gives rise to a molten steel flow 25. In this case, however, the applied magnetic field is attenuated by an induction current magnetic field generated by mold copper plates, etc. Accordingly, the magnetic flux density produced within the mold is only on the order of about several hundred Gauss, and it is difficult to increase the electromagnetic force 24.

Figure 12:
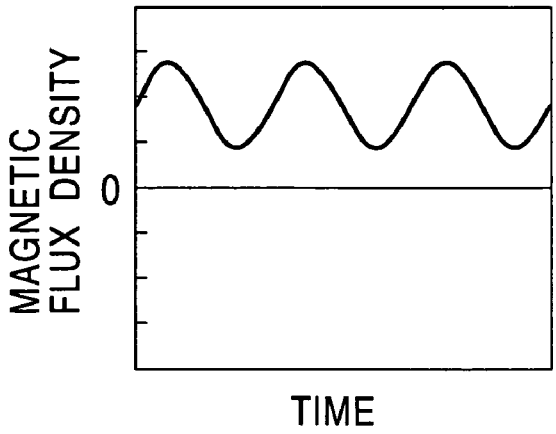
FIG. 12 is a waveform chart showing one example of a magnetic flux density produced under application of AC and DC magnetic fields.
Figure 13:
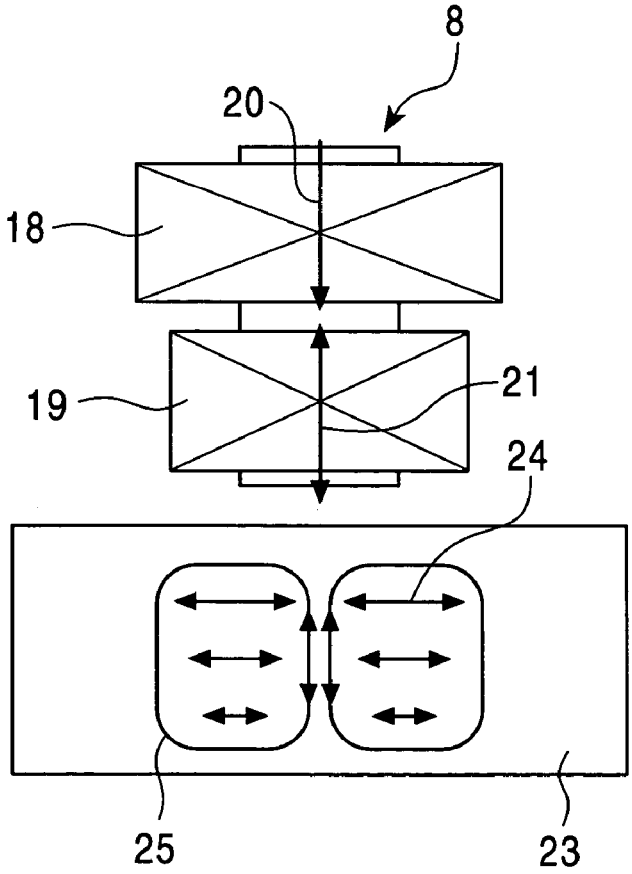
FIG. 13 is a schematic view for explaining molten steel flows occurring under application of AC and DC magnetic fields.

On the other hand, as shown in FIG. 13, when an AC and DC superimposed magnetic field providing a magnetic flux density as represented by a waveform shown in FIG. 12, by way of example, is applied by the AC supplied coil 19 and the DC supplied coil 18 in the direction of transverse width of the mold (the direction 21 of the AC magnetic field and the direction 20 of the DC magnetic field) the magnetic flux density produced within the mold can be increased to a level of several thousands Gauss and the electromagnetic force 24 can also be increased.

An AC component of the electromagnetic force (i.e., an electromagnetic pumping force) causes disorder in the molten steel flow 25, whereby movement of heat and material is activated and the Washing effect is also promoted. Since an AC magnetic field is gradually attenuated due to the skin effect as it approaches the interior of a material, the electromagnetic pumping force is relatively large near a widthwise surface a solidified shell, but relatively small near the center of the molten steel in the direction of transverse width of the mold. A DC magnetic field is hardly attenuated across the overall transverse width of the mold. Near the center of the molten steel in the direction of transverse width of the mold, therefore, a DC component of the electromagnetic force (i.e., an electromagnetic braking force) acting to brake the molten steel prevails over the periodically varying component that is attenuated there. As a result, it is possible to attenuate flows branched from an ejected flow to move upward and downward, and at the same time to activate the molten steel flow near the widthwise surface of the solidified shell. In addition, because of employing the fixed AC magnetic field in which a wave does not move in the direction of transverse width of the mold, the molten steel flow in a meniscus area near long walls of the casting mold 6 becomes a non-directional molten steel flow 26 that moves in random directions, as shown in FIG. 9. This prevents generation of a circulating flow 27, shown in FIG. 14, that moves along the periphery of the casting mold 6. Hence, neither vortex 29 nor stagnation 30 is produced due to collision between the circulating flow 27 and an ejected-and-reversed surfacing flow 28 from the immersion nozzle 1, thus resulting in a remarkable reduction of such disadvantages as the entrainment of flux powder with the vortex and the capture of inclusions by the solidified shell in the stagnation.

In order to sufficiently develop the above-mentioned effects, the AC and DC superimposed magnetic field is preferably applied from one or more pairs of magnetic poles 22 disposed in an opposing relation above and/or below the ejection port of the immersion nozzle 1, as shown in FIG. 9. Applying the AC and DC superimposed magnetic field above the ejection port of the immersion nozzle 1 can hold down the occurrence of the vortex and stagnation in the meniscus area, and applying it below the ejection port of the immersion nozzle 1 can promote braking against the downward flow from the immersion nozzle 2 and enlarge the range within which the Washing effect exerts. Furthermore, by arranging the magnetic poles in an opposing relation, the magnetic field can be symmetrically applied from both the sides of the casting mold in the direction of transverse width of the mold. Still further, by arranging one or more pairs of the magnetic poles, the molten steel flow is disordered near the widthwise surface of the solidified shell more evenly in the direction of longitudinal width of the mold, and the Washing effect can be developed thoroughly in the direction of longitudinal width of the mold with more ease.

From the standpoint of apparatus construction, the AC supplied coils 19 and the DC supplied coil 18 are preferably wound over the same iron core 8, as shown in FIG. 9, for ease in positioning of the applied magnetic fields, aligned application of the AC and DC superimposed magnetic field to the desired positions, and independent adjustment of DC and AC components of the superimposed magnetic field. Additionally, the AC supplied coils 19 are each preferably wound over one of a plurality of magnetic poles 22 which are formed by branching a front end portion of the iron core 8 into the shape of comb teeth, whereas the DC supplied coil 18 may be wound over a root (referred to as a "common pole") in common to the magnetic poles 22 formed side by side in the shape of comb teeth at the front end portion of the iron core 8.

Also, in the modification of this aspect of the present invention, the AC magnetic field preferably has frequency of 0.01-50 Hz. If the frequency is lower than 0.01 Hz, the intensity of a produced electromagnetic force becomes insufficient, and if the frequency exceeds 50 Hz, it is difficult for the molten metal flow to follow changes of the electromagnetic force. In any case, it is difficult to make the molten metal flow disordered satisfactorily near the widthwise surface of the solidified shell.

EXAMPLE (Table 3)

A strand of low carbon-and-Al killed steel being 1500 mm wide and 220 mm thick was cast by pouring the molten killed steel at a casting rate of 1.8 m/min and 2.5 m/min and an immersion nozzle ejection angle of 15° downward from the horizontal with a continuous casting machine of the vertical bending type. In this casting step, experiments were conducted by employing the apparatus shown in FIG. 9, and applying magnetic fields to a portion of the strand corresponding to the mold position under various conditions of applying the magnetic fields as listed in Table 3. A cast slab was subjected to measurement of a surface defect index determined by inspecting surface defects of a steel plate after being rolled, and a machining crack index determined by inspecting inclusion-based machining cracks caused during pressing of a steel plate. The surface defect index and the machining crack index are each defined as an index that takes a value of 1.0 when electromagnetic flow control is not carried out.

In table 3, in each pole to which a moving AC magnetic field was applied, AC supplied coils were arranged in division to three sets so as to provide a moving-magnetic-field pole pitch of 500 mm, and three-phase AC currents were supplied to the three sets of coils with different phases from each other. In each pole to which a fixed AC magnetic field was applied, a single-phase AC current was supplied to each of AC supplied coils wound over the respective magnetic poles, and the phase of a magnetic flux density was set to the same for each magnetic pole. Also, in Table 3, the intensity of the AC magnetic field is represented by an effective value of the magnetic flux density at an inner surface position of a mold copper plate when the AC magnetic field is solely applied, and the intensity of the DC magnetic field is represented by a value of the magnetic flux density at the center of the cast slab in the direction of thickness thereof when the DC magnetic field is solely applied. The pole, in which the intensities of both the AC and DC magnetic fields are not 0 T, represents a pole to which the AC and DC superimposed magnetic field was applied. As shown in Table 3, the conditions 1 to 5 represent Comparative Examples departing from the scope of the present invention, and the condition 6 represents Example falling within the scope of the present invention.

Measurement results of the surface defect index and the machining crack index are also listed in Table 3. Note that the measured result is expressed by an average of two values measured for two different casting rate conditions.

In the Comparative Examples of Table 3, the DC magnetic field and the moving magnetic field (moving AC magnetic field) were applied solely or in superimposed fashion. When only the DC magnetic field was applied, supply of the molten steel heat was insufficient and a claw-like structure grew in an initially solidified portion. The claw-like structure catches flux powder and increased the surface defect index. When only the moving magnetic field was applied, growth of the claw-like structure could be held down, but the electromagnetic braking force was so small that inclusions intruded into a deeper area of a not-yet-solidified molten steel bath within the cast slab. In addition, a vortex and stagnation were caused in the meniscus area upon collision between the circulating flow along the periphery of the casting mold and the ejected-and-reversed surfacing flow. The intrusion of inclusions into the deeper area of the not-yet-solidified molten steel bath within the cast slab increased the machining crack index. The vortex brought about entrainment of flux powder, and the stagnation promoted the capture of inclusions by the solidified shell. Any of the vortex and the stagnation increased the surface defect index. By superimposing the DC magnetic field on the moving magnetic field, the inclusions could be avoided from intruding into the deeper area of the not-yet-solidified molten steel bath, but the occurrence of vortex and stagnation could not be avoided. Under the best condition 5 among the Comparative Examples in which the moving magnetic field and the DC magnetic field were applied to both upper and lower poles, therefore, the machining crack index was reduced down to 0.1, but the surface defect index still remained as high as 0.2.

By contrast, the Example of Table 3 employed the condition 6 in which the fixed AC magnetic field was applied instead of the moving magnetic field employed in the condition 5. Under the condition 6, the electromagnetic pumping force was caused to act upon the widthwise surface of the solidified shell to enhance the Washing effect, and the electromagnetic braking force was caused to act upon a central portion of the cast slab in the direction of thickness thereof to reduce the flow speeds of the molten steel flows (upward and downward flows branched from the ejected flow) and to promote creation of laminar flows. Furthermore, generation of the circulating flow in the meniscus area could be held down, and the vortex and stagnation were avoided from being produced there. As a result, both the surface defect index and the machining crack index could be reduced down to 0.05 that was not obtained with Comparative Examples.

Aspect B of Invention: "Application of Intermittent Static Magnetic Field"

Figure 7:
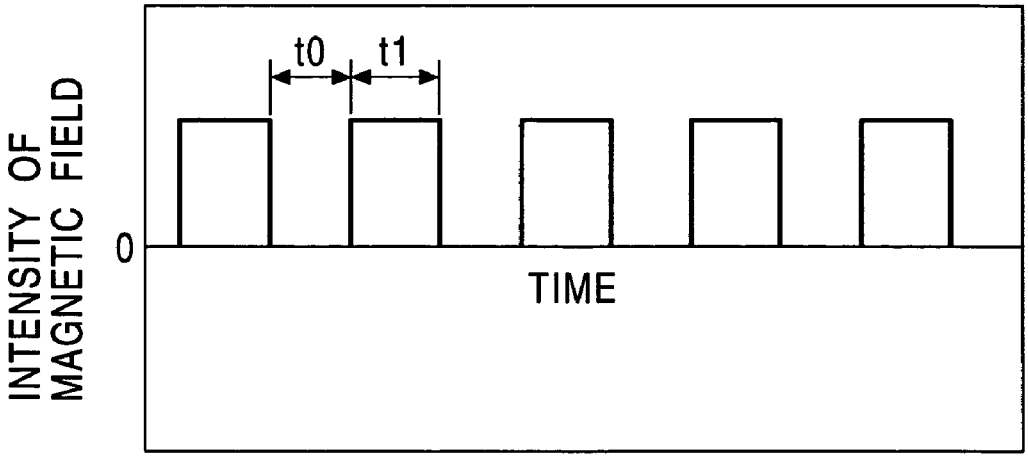
FIG. 7 is a chart illustrating application of a magnetic field according to the present invention.

In this aspect of the present invention, casting is performed while applying a static magnetic field in the direction of longitudinal width of a casting mold to prevent the flux entrainment, but the static magnetic field is intermittently applied by turning on/off application of the magnetic field in an alternate manner, as shown in FIG. 7, rather than continuously applying a constant magnetic field in steady fashion (holding an on-state). In FIG. 7, an on-time is represented by t1 and an off-time is represented by t2.

By so intermittently applying the static magnetic field, the vector of an eddy current generated in an acting area of the magnetic field is greatly changed upon the on/off switching, and a micro flow of a molten metal is produced in the acting area. The produced micro flow contributes to preventing semi-solidification of the molten metal near the surface thereof, and to almost completely eliminate the occurrence of surface segregation.

With this aspect of the present invention, therefore, both the flux entrainment and the surface segregation can be prevented, but the degree of the resulting effect depends on how the on-time t1 and the off-time t0 are set. More specifically, if t0 and t1 are too short, the applied magnetic field becomes close to a state resulting from application of an AC magnetic field, whereby the flow speed of the surface molten metal cannot be reduced satisfactorily and the flux entrainment is caused. If t0 is too long, the flow speed of the molten metal is increased and the effect of effecting the flux entrainment becomes insufficient. Also, if t1 is too long, the flow speed of the molten metal is so reduced that the surface segregation is noticeable.

Experiments were conducted to determine the ranges of t0 and t1 in which both the flux entrainment and the surface segregation could be reduced satisfactorily. As a result, t0=0.10-30 seconds and t1=0.10-30 seconds were obtained. Thus, in this aspect of the present invention, the magnetic field is preferably intermittently applied under condition of t0=0.10-30 seconds and t1=0.10-30 seconds. More preferably, t0 and t1 are set to satisfy t0=0.3-30 seconds and t1=0.3-30 seconds.

Furthermore, the advantages of this aspect of the present invention are obtained most remarkably when the static magnetic field is applied to the surface of the molten metal. It is therefore preferable to apply the static magnetic field to the surface of the molten metal. Even when the static magnetic field is applied to the interior of the molten metal, however, similar advantages can also be obtained so long as an influence of the static magnetic field is transmitted to the surface flow of the molten metal through an internal flow of the molten metal.

According to this aspect of the present invention, as described above, casting of a high-quality metal slab can be achieved which is free from the surface segregation and suffers from the flux entrainment at a less degree.

EXAMPLES (Tables 4 and 5)

Figure 8:
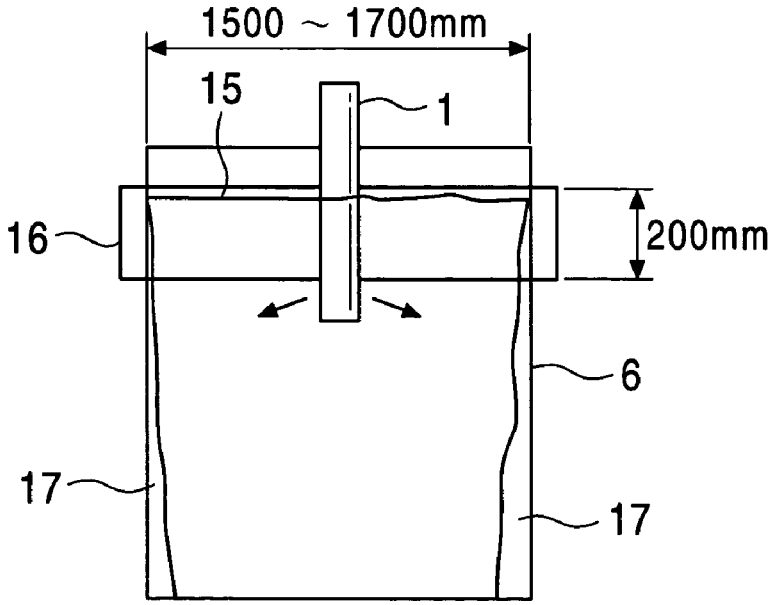
FIG. 8 is a schematic view showing process parameters of casting with application of a static magnetic field.

About 300 tons of ultra low carbon-and-Al killed steel (having a. typical chemical composition listed in Table 4) was smelted using the converter—RH process, and a slab being 1500-1700 mm wide and 220 mm thick was cast by pouring the molten killed steel into a casting mold 6 at a rate of 4-5 ton/min from an immersion nozzle 1 with a continuous casting machine, as shown in FIG. 8. In this slab casting step, experiments were conducted by arranging electromagnetic coils 16 on both sides of the mold 6 in an opposing relation at a level corresponding to the position of a surface 15 of the molten steel, and applying a static magnetic field in the direction of transverse width of the mold (direction perpendicular to the drawing sheet of FIG. 8) under various conditions with a maximum magnetic flux density of 0.3 T.

In the experiments, three characteristics, i.e., surface segregation, flux-based surface defects, and a bubble/-inclusion amount, were measured for each condition of applying the static magnetic field in accordance with the following procedures. Surface Segregation: After grinding the cast slab, the slab was subjected to etching and the number of segregates per 1 $m^2$ was counted by visual observation.

Flux-based Surface Defects: Surface defects in a coil obtained after cold rolling of the cast slab were visually observed, and after picking a defective sample, the number of defects caused by entrainment of mold flux was counted by analyzing the defects.

Inclusion Amount: Inclusions were extracted by the slime extracting process from a portion of the cast slab at a position corresponding to a ¼ thickness thereof, and the weight of the extracted inclusions was measured.

The experimental results are listed in Table 5 along with the conditions of applying the static magnetic field. Note that evaluation values of the above three items are each represented in terms of an index (numeral value obtained by multiplying a ratio of the measured data to the worst data among all the conditions by 10).

As seen from Table 5, in the Examples according to this aspect of the present invention in which the static magnetic field was intermittently applied, the surface segregation was not observed, and both the flux-based surface defects and the inclusion amount were reduced. Among these Examples, in Examples 1 and 4-7 in which the on-time t1 was set to be in the range of 0.10 to 30 seconds, both the flux-based surface defects and the inclusion amount were further reduced. Furthermore, in the Comparative Examples of Table 5 in which the static magnetic field was applied at the constant strength, there occurred a contradiction that when the intensity of the static magnetic field is increased, both the flux-based surface defects and the inclusion amount were reduced, but the surface segregation was increased. By contrast, in the Examples of Table 5, such a contradiction did not occur, and the surface segregation, the flux-based surface defects and the inclusion amount were all reduced.

Another Aspect of Invention

An AC magnetic field may be moved in a longitudinally symmetrical relation from both ends toward the center of a casting mold in the direction of longitudinal width thereof.

Figure 14:
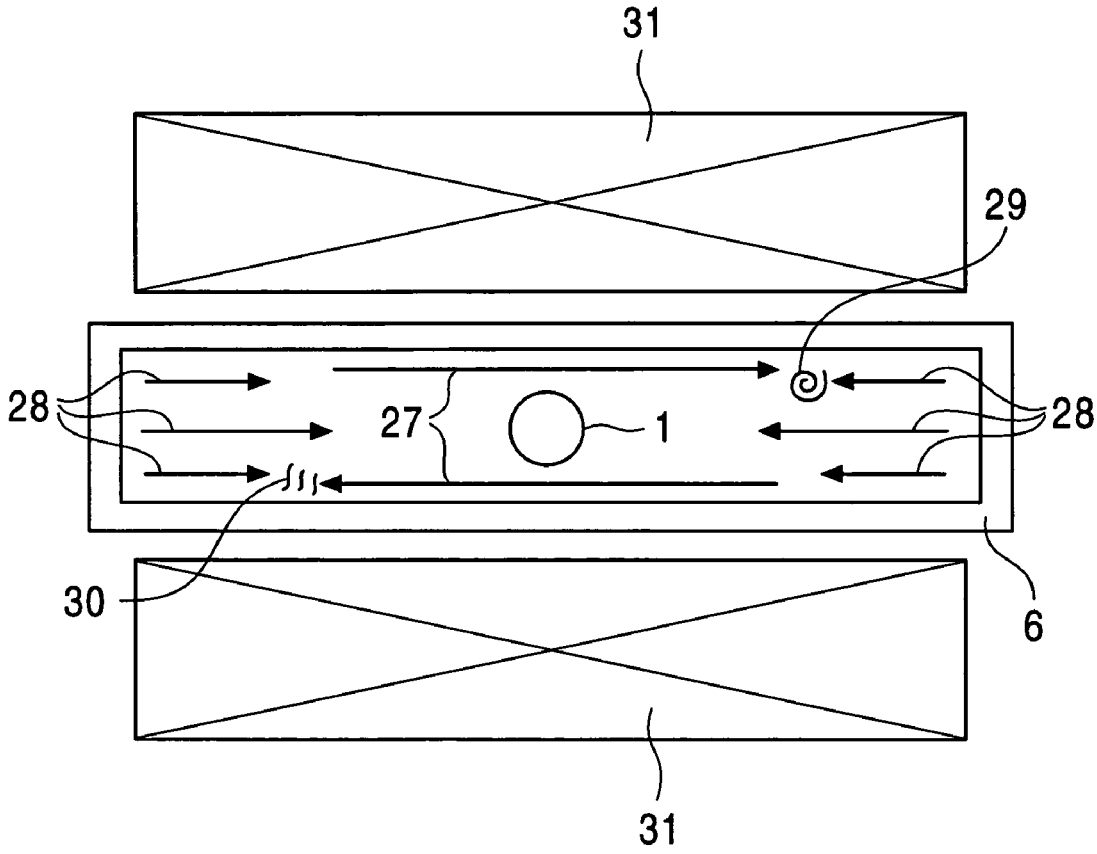
FIG. 14 is a schematic sectional plan view showing interference between a circulating flow and an ejected-and-reversed surfacing flow caused by electromagnetic agitation in a meniscus area (the surface of molten steel)

With this other aspect of the present invention, similarly to the above-described aspect, an AC and DC superimposed magnetic field is applied to a molten metal at two positions (in two steps) spaced in the casting direction (direction of height of a casting mold) so as to spread in the direction of thickness of a cast slab (direction of short side (transverse width) of the mold). However, this other aspect of the present invention differs from the above-described aspect in producing a moving AC magnetic field and from the conventional method in direction of movement of an AC magnetic field. More specifically, in the conventional method, the AC magnetic field is moved from one end toward the other end of the mold in the direction of width of the cast slab (direction of long side (longitudinal width) of the mold). By contrast, with this aspect of the present invention, the AC magnetic field is moved in a longitudinally symmetrical relation from both ends toward the center of the mold in the direction of longitudinal width thereof. In the case of moving the AC magnetic field similarly to the conventional method, a horizontal circulating flow along the periphery of the casting mold is generated, as shown in FIG. 14, even when a DC magnetic field is superimposed on the AC magnetic field. Therefore, the occurrence of a vortex and stagnation due to collision between the circulating flow and an ejected-and-reversed surfacing flow cannot be prevented, which makes it difficult to prevent entrainment of flux powder at the surface of the molten metal and capture of bubbles and inclusions by a widthwise surface of a solidified shell.

Figure 15:
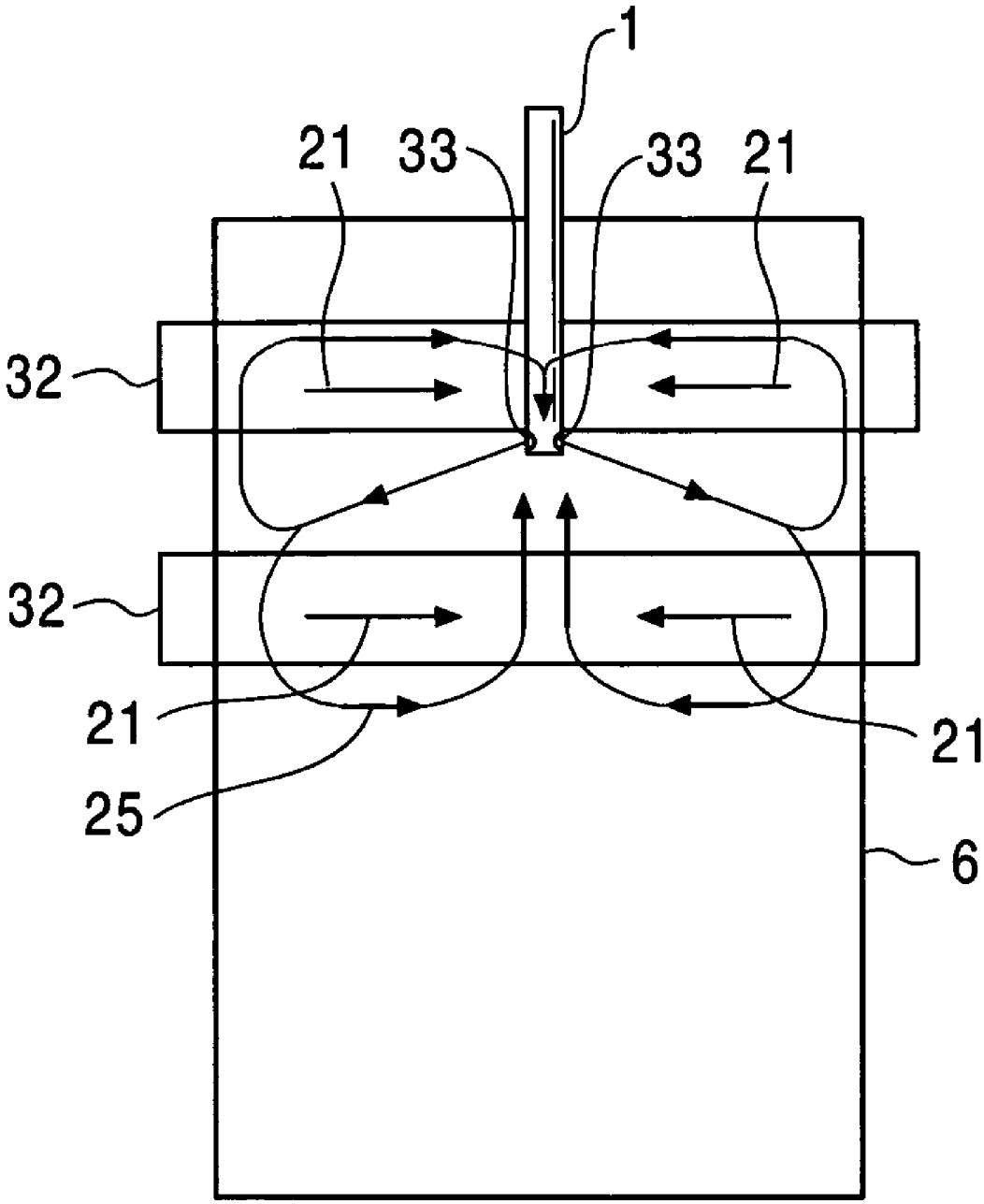
FIG. 15 is a schematic side view showing a flow pattern of molten steel produced based on an ejected molten steel flow under two-step superimposed application of a transversely-symmetrical moving AC magnetic field and a DC magnetic field.
Figure 16:
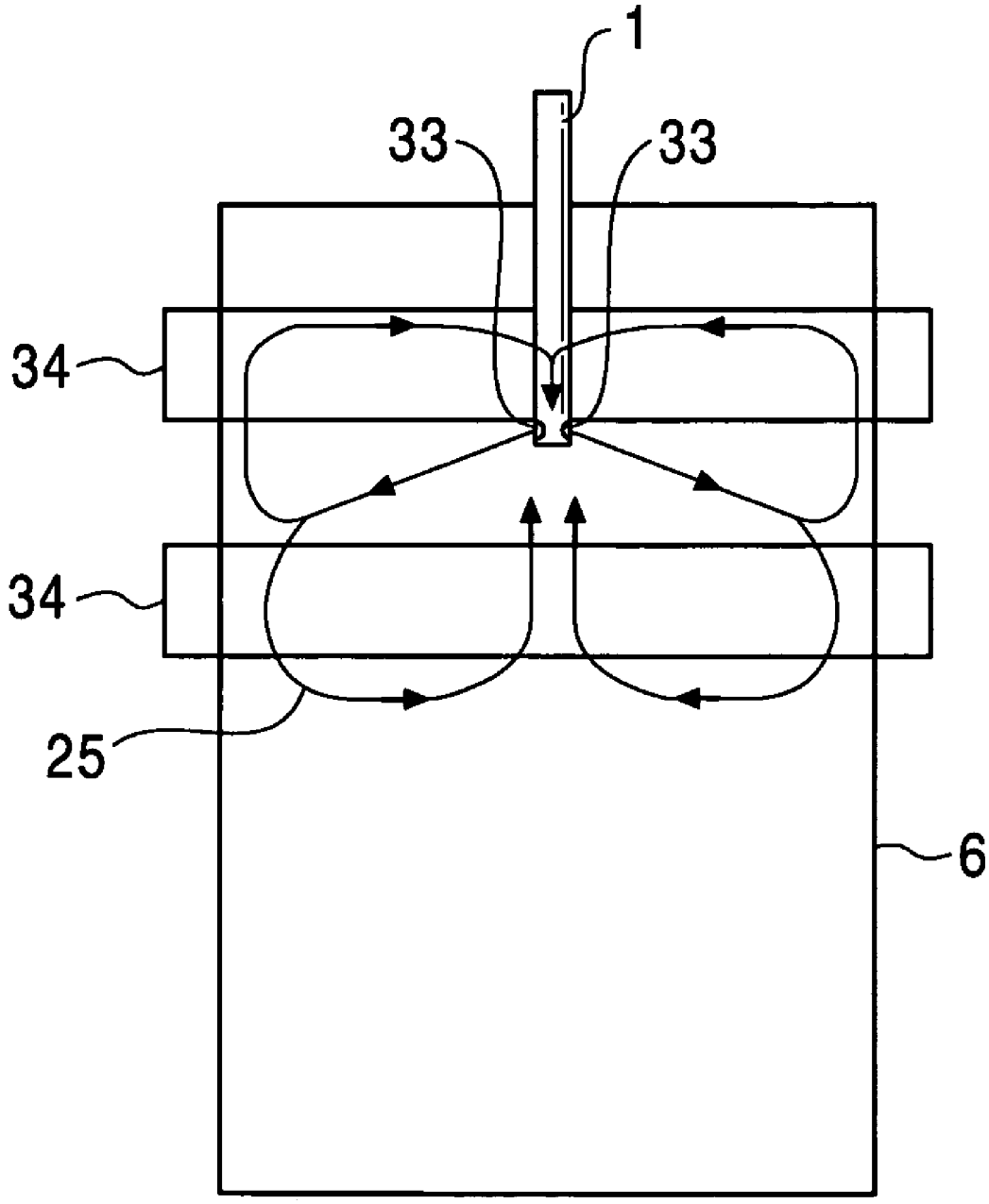
FIG. 16 is a schematic side view showing a flow pattern of molten steel produced based on an ejected molten steel flow under two-step application of a DC magnetic field alone.

With this aspect of the present invention, since the AC magnetic field is moved in a longitudinally symmetrical relation about the center of the mold in the direction of longitudinal width thereof, the above-mentioned circulating flow is not produced and there is nothing against which the ejected-and-reversed surfacing flow collides. Accordingly, neither vortex nor stagnation is produced. Flows moving from both longitudinal ends of the mold under urging by the AC magnetic field (longitudinally-symmetrical moving AC magnetic field) join with each other at the longitudinal center of the mold, but the joined flow is maintained in a laminar state and streams such that a flow near the surface (meniscus) of the molten metal descends and a flow below an ejection port of an immersion nozzle ascends. Such a behavior was confirmed based on experiments and calculations (see FIGS. 15 and 16).

Furthermore, on the surface side of the molten metal in the direction of thickness of cast slab (near the widthwise surface of the solidified shell), the AC magnetic field develops due to the skin effect an agitating force prevailing over a braking force developed by the DC magnetic field, thereby activating the flow in such an area and preventing the capture of bubbles and inclusions into the cast slab. On the other hand, on the central side of the molten metal in the direction of thickness of cast slab, the agitating force developed by the AC magnetic field is attenuated and the braking force developed by the DC magnetic field acts primarily. Accordingly, flows (upward and downward flows branched from the ejected flow) in a central area are damped, whereby disorder of the flow speed of the surface molten metal is held down and entrainment of flux powder is avoided. At the same time, the flow speed of the downward flow is reduced and large-sized inclusions are prevented from intruding into a deeper area.

In this aspect of the present invention, the AC magnetic field preferably has frequency of 0.1-10 Hz. If the frequency is lower than 0.1 Hz, it is difficult to produce a molten metal flow enough to develop the Washing effect along the widthwise surface of the solidified shell. Conversely, if the frequency exceeds 10 Hz, the applied AC magnetic field is attenuated by mold copper plates, and hence it is also difficult to produce a molten metal flow enough to develop the Washing effect along the widthwise-surface of the solidified shell.

Figure 17A:
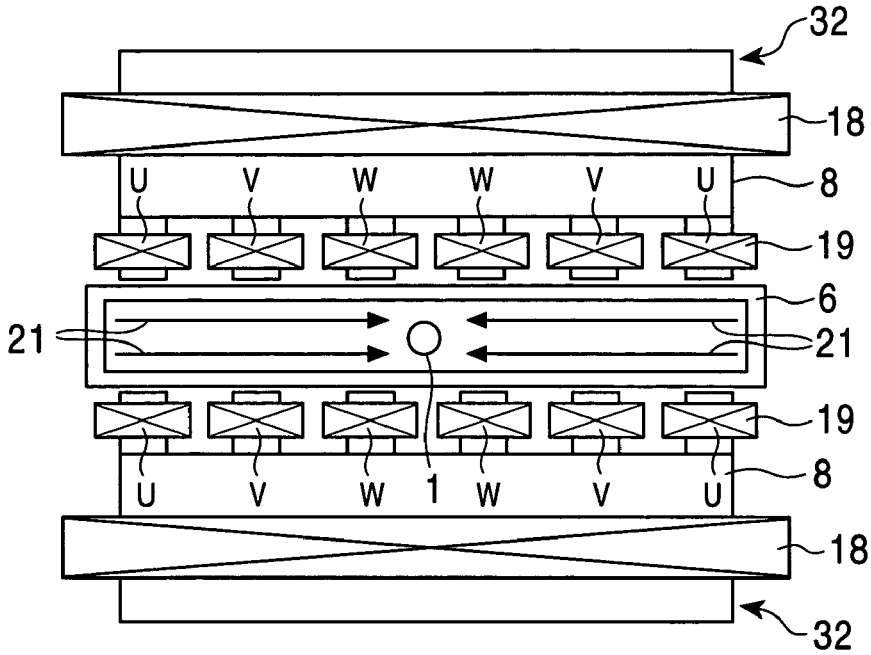
Figure 17B:
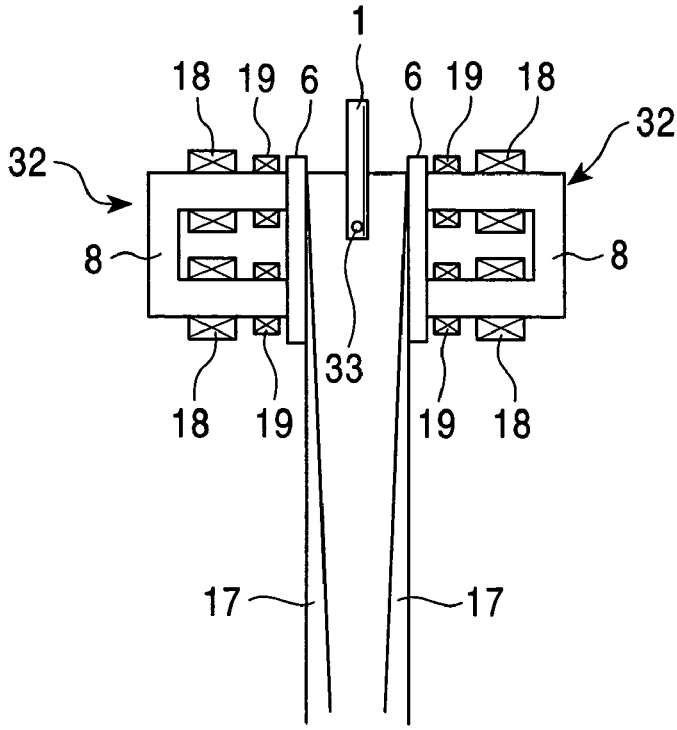

FIGS. 17A and 17B show one example of an apparatus suitable for implementing the above-described method according to this aspect of the present invention; FIG. 17A is a schematic sectional plan view and FIG. 17B is a schematic sectional side view. In the apparatus, a pair of electromagnets 7 for both AC and DC currents are arranged in an opposing relation on both sides of a casting mold 6 in the direction of transverse width thereof with an immersion nozzle 1 placed within the mold 6.

An iron core (yoke) 8 of each AC/DC electromagnet 32 has magnetic poles spaced in the vertical directions. Upper and lower magnetic poles. (an upper pole and a lower pole) are positioned respectively above and below an ejection port of the immersion nozzle 1, and the upper and lower poles of both the AC/DC electromagnets 32 are aligned with each other in the direction of thickness of the cast slab. DC coils 18 are wound such that the opposing magnetic poles on both the sides of the mold 6 have polarities complementary to each other (i.e., if the magnetic pole on one side is N, the magnetic pole on the other side is S).

A front end portion of each magnetic pole is divided into plural pairs (three in the illustrated apparatus) of branches. An AC coil 11 is wound over each branch, and the DC coil 18 is wound over a root in common to all the branches. In the illustrated apparatus, a three-phase AC current is supplied to the AC coils 19. Assuming different phases of the three-phase AC current to be U, V and W phases, respectively, the W phase is supplied to two first AC coils 19 counting to the left and right from the center of mold in the direction of longitudinal width thereof, the V phase is supplied to two second AC coils 19, and the U phase is supplied to two third AC coils 19. By supplying different phases of a multi-phase AC current in a longitudinally symmetrical relation about the center of the mold in the direction of longitudinal width thereof, the AC magnetic field produced by the multi-phase AC current can be moved in directions indicated by arrows 21, i.e., directions from the both ends toward the center of the mold in the direction of longitudinal width thereof in a longitudinally symmetrical relation.

Also, by winding the AC coils and the DC coil over the branches and the root of the same magnetic pole, it is possible to accurately set positions to which the AC and DC superimposed magnetic field is applied, and easily adjust the intensity of frequency of each of the Ac and DC magnetic fields independently.

From the standpoint of making the molten metal flow more uniform near a widthwise surface of a solidified shell 17 in the direction of width of the cast slab, the number of branches formed in the front end portion of each magnetic pole is preferably set depending on the width of the cast slab.

Further, from the standpoint of evenly activating the molten metal flow near the widthwise surface of the solidified shell 17 over the entire width of the cast slab, the AC/DC electromagnets are preferably disposed so as to cover the entire width of the cast slab as illustrated.

EXAMPLE (Table 6)

A strand of low carbon-and-Al killed steel being 1500 mm wide and 220 mm thick was cast by pouring the molten killed steel at a casting rate of 1.8 m/min and 2.5 m/min and an immersion nozzle ejection angle of 15° downward from the horizontal with a continuous casting machine of the vertical bending type. In this casting step, experiments were conducted by employing the same apparatus as shown in FIG. 17, and applying magnetic fields to a portion of the strand corresponding to the mold position under various conditions of applying the magnetic fields as listed in Table 6. A cast slab was subjected to measurement of a surface defect index determined by inspecting surface defects of a steel plate after being rolled, and a machining crack index determined by inspecting inclusion-based machining cracks caused during pressing of a steel plate. The surface defect index and the machining crack index are each defined as an index that takes a value of 1.0 when electromagnetic flow control is not carried out.

In Table 6, in each magnetic pole represented by the moving type A, different phases of the three-phase AC supplied to the AC coils in FIG. 17 were arranged in the order of the U, V, W, U, V and W phase successively from the left end in the direction of longitudinal width of the mold instead of the arrangement shown FIG. 17 so as to produce the horizontal circulating flow in the molten steel as with the conventional method. A thus-produced AC magnetic field (referred to as a type-A AC magnetic field; corresponding to the conventional moving magnetic field) was moved from one end to the other end of the mold in the direction of longitudinal width thereof. On the other hand, in each magnetic pole represented by the moving type B, different phases of the three-phase AC supplied to the AC coils were arranged in a longitudinally symmetrical relation in the direction of longitudinal width of the mold as shown FIG. 17 so as to produce the flows in the molten steel moving from both the ends to the center of the mold in the direction of longitudinal width thereof in accordance with this aspect of the present invention. A thus-produced AC magnetic field (referred to as a type-B AC magnetic field) was moved in a longitudinally symmetrical relation from both the ends to the center of the mold in the direction of longitudinal width thereof.

Also, in Table 6, the intensity of the AC magnetic field is represented by an effective value of the magnetic flux density at an inner surface position of a mold copper plate when the AC magnetic field is solely applied, and the intensity of the DC magnetic field is represented by a value of the magnetic flux density at the center of the cast slab in the direction of thickness thereof when the DC magnetic field is solely applied. The magnetic pole, in which the intensities of both the AC and DC magnetic fields are not 0 T, represents a pole to which the AC and DC superimposed magnetic field was applied. As shown in Table 6, the conditions 1 to 5 represent Comparative Examples departing from the scope of the present invention, and the condition 6 represents Example falling within the scope of the present invention.

Measurement results of the surface defect index and the machining crack index are also listed in Table 6. Note that the measured result is expressed by an average of two values measured for two different casting rate conditions.

In Comparative Examples, the type-A AC magnetic field and the DC magnetic field were applied solely or in superimposed fashion. When only the DC magnetic field was applied, supply of the molten steel heat was insufficient and a claw-like structure grew in an initially solidified portion. The claw-like structure catches flux powder and increased the surface defect index. When only the type-A AC magnetic field was applied, growth of the claw-like structure could be held down, but the electromagnetic braking force was so small that inclusions intruded into a deeper area of a not-yet-solidified molten steel bath within the cast slab. In addition, a vortex and stagnation were caused in the meniscus area upon collision between the circulating flow along the periphery of the casting mold and the ejected-and-reversed surfacing flow. The intrusion of inclusions into the deeper area of the not-yet-solidified molten steel bath within the cast slab increased the machining crack index. The vortex brought about entrainment of flux powder, and the stagnation promoted the capture of inclusions by the solidified shell. Any of the vortex and the stagnation increased the surface defect index. By superimposing the DC magnetic field on the type-A AC magnetic field, the inclusions could be avoided from intruding into the deeper area of the not-yet-solidified molten steel bath, but the occurrence of vortex and stagnation could not be avoided. Under the best condition 5 among Comparative Examples in which the type-A AC magnetic field and the DC magnetic field were applied to both upper and lower poles, therefore, the machining crack index was reduced down to 0.1, but the surface defect index still remained as high as 0.2.

By contrast, the Example of Table 6 employed the condition 6 in which the type-B AC magnetic field was applied (frequency was changed from 2 Hz to 0.5 Hz for optimization) instead of the type-A AC magnetic field employed in the condition 5. Under the condition 6, the Washing effect along the widthwise surface of the solidified shell was enhanced, and the electromagnetic braking force was caused to act upon a central portion of the cast slab in the direction of thickness thereof to reduce the flow speeds of the molten steel flows (upward and downward flows branched from the ejected flow) and to promote creation of laminar flows. Further, generation of the circulating flow in the meniscus area could be held down, and the vortex and stagnation were avoided from being produced there. As a result, both the surface defect index and the machining crack index could be reduced down to 0.05 that was not obtained with the Comparative Examples.

With the above-described aspects of the present invention, in the continuous casting process of steel, the upward and downward flows branched from the ejected flow can be damped, and at the same time the molten steel flow along the widthwise surface of the solidified shell can be activated. In addition, a vortex and stagnation can be prevented from being caused upon collision between the circulating flow created by electromagnetic agitation and the ejected-and-reversed surfacing flow in the meniscus area. Therefore, a cast slab having even higher quality can be produced.

Thus, the present invention can provide the following superior advantages. A metal slab can be cast which is much less susceptible to bubbles and non-metal inclusions captured in the cast slab, surface segregation, as well as surface defects and internal inclusions attributable to mold flux. Hence, a high-quality metal product can be produced.

While the present invention has been described above in connection with several preferred embodiments, it is to be expressly understood that those embodiments are solely for illustrating the invention, and are not to be construed in a limiting sense. After reading this disclosure, those skilled in this art will readily envision insubstantial modifications and substitutions of equivalent materials and techniques, and all such modifications and substitutions are considered to fall within the true scope of the appended claims.

TABLE 1

| C | Si | Mn | P | S | Al | Ti |
|---|---|---|---|---|---|---|
| 0.0015 | 0.02 | 0.08 | 0.015 | 0.004 | 0.04 | 0.04 |

TABLE 2

| | Magnetic Flux Density at Widthwise Center (T) | Layout of Electromagnets | Type of AC Current | Frequency (Hz) | Surface Segregation Index (–) | Flux-based Defect Index (–) | Bubble/Inclusion Amount Index (–) | Overall Evaluation |
|---|---|---|---|---|---|---|---|---|
| Comparative Example 1 | 0 | — | — | — | 10 | 10 | 10 | x |
| Comparative Example 2 | 0 | — | — | — | 7.0 | 9.5 | 9.5 | x |
| Comparative Example 3 | 0.1 | FIG. 4 | Three Phase | 5 | 0 | 5.1 | 2.5 | x |
| Comparative Example 4 | 0.1 | FIG. 4 | Three Phase | 10 | 0 | 8.0 | 3.2 | x |
| Comparative Example 5 | 0.1 | FIG. 4 | Three Phase | 20 | 0 | 9.5 | 2.8 | x |
| Example 1 | 0.1 | FIG. 2 | Single Phase | 0.05 | 0 | 3.9 | 1.4 | Δ |
| Example 2 | 0.1 | FIG. 2 | Single Phase | 0.10 | 0 | 3.1 | 1.0 | ○ |
| Example 3 | 0.1 | FIG. 2 | Single Phase | 5 | 0 | 3.2 | 1.2 | ○ |
| Example 4 | 0.1 | FIG. 2 | Single Phase | 60 | 0 | 0.2 | 0.9 | ○ |
| Example 5 | 0.1 | FIG. 3 | Single Phase | 5 | 0 | 0.2 | 0.6 | ○ |
| Example 6 | 0.1 | FIG. 3 | Single Phase | 20 | 0 | 0.1 | 0.5 | ○ |
| Example 7 | 0.1 | FIG. 3 | Single Phase | 60 | 0 | 0.2 | 0.8 | ○ |
| Example 8 | 0.1 | FIG. 3 | Single Phase | 65 | 0 | 3.2 | 3.0 | Δ |

TABLE 3

| | Magnetic Field Applying Conditions | | | | | | | Steel Plate Examination Results | | |
|---|---|---|---|---|---|---|---|---|---|---|
| | Upper Pole | | | Lower Pole | | | | | | |
| | AC Magnetic Field | | DC Magnetic Field | AC Magnetic Field | | | DC Magnetic Field | Surface Defect | Machining | |
| No. | Intensity | Frequency | Intensity | Type | Intensity | Frequency | Intensity | Index | Crack Index | Remarks |
| 1 | 0 T | — | 0.3 T | — | 0 T | — | 0.3 T | 0.3 | 0.2 | Comparative Example |
| 2 | 0.08 T | 2 Hz | 0 T | — | 0 T | — | 0.3 T | 0.3 | 0.2 | Comparative Example |
| 3 | 0.08 T | 2 Hz | 0.3 T | — | 0 T | — | 0 T | 0.2 | 0.3 | Comparative Example |
| 4 | 0.08 T | 2 Hz | 0.3 T | — | 0 T | — | 0.3 T | 0.2 | 0.2 | Comparative Example |
| 5 | 0.08 T | 2 Hz | 0.3 T | Moving | 0.08 T | 2 Hz | 0.3 T | 0.2 | 0.1 | Comparative Example |
| 6 | 0.08 T | 5 Hz | 0.3 T | Fixed | 0.08 T | 5 Hz | 0.3 T | 0.05 | 0.05 | Example |

Moving Type: 500 mm pole pitch of moving magnetic. field; supply of three-phase AC current
Fixed Type: supply of single-phase AC current

TABLE 4

(%)

| C | Si | Mn | P | S | Al | Ti |
|---|---|---|---|---|---|---|
| 0.0015 | 0.02 | 0.08 | 0.015 | 0.004 | 0.04 | 0.04 |

TABLE 5

| | Magnetic Flux Density at Widthwise Center (T) | t0 (sec) | t1 (sec) | Surface Segregation Index (–) | Flux-based Defect Index (–) | Inclusion Amount Index (–) |
|---|---|---|---|---|---|---|
| Comparative Example 1 | 0 | 0 | — | 3.2 | 10 | 10 |
| Comparative Example 2 | 0 | 0 | — | 3.0 | 9.5 | 9.5 |

TABLE 5-continued

| | Magnetic Flux Density at Widthwise Center (T) | t0 (sec) | t1 (sec) | Surface Segregation Index (−) | Flux-based Defect Index (−) | Inclusion Amount Index (−) |
|---|---|---|---|---|---|---|
| Comparative Example 3 | 0.1 | 0 | — | 6 | 5.1 | 7.5 |
| Comparative Example 4 | 0.2 | 0 | — | 7.5 | 2.5 | 4.5 |
| Comparative Example 5 | 0.3 | 0 | — | 10 | 1.1 | 2.8 |
| Example 1 | 0.3 | 0.05 | 0.05 | 0 | 4.2 | 2.2 |
| Example 2 | 0.1 | 0.10 | 0.15 | 0 | 3.1 | 1.0 |
| Example 3 | 0.1 | 2 | 2 | 0 | 3.2 | 1.5 |
| Example 4 | 0.3 | 10 | 7 | 0 | 0.2 | 0.5 |
| Example 5 | 0.3 | 10 | 5 | 0 | 0.2 | 0.6 |
| Example 6 | 0.3 | 30 | 20 | 0 | 0.1 | 0.5 |
| Example 7 | 0.3 | 20 | 30 | 0 | 0.2 | 0.8 |
| Example 8 | 0.3 | 30 | 32 | 0 | 3.2 | 3.0 |

TABLE 6

| | Magnetic Field Applying Conditions | | | | | | | | Steel Plate Examination Results | | |
|---|---|---|---|---|---|---|---|---|---|---|---|
| | Upper Pole | | | | Lower Pole | | | | | | |
| | AC Magnetic Field | | | DC Magnetic | AC Magnetic Field | | | DC Magnetic | | | |
| No. | Moving Type | Intensity | Frequency | Field Intensity | Moving Type | Intensity | Frequency | Field Intensity | Surface Defect Index | Machining Crack Index | Remarks |
| 1 | | 0 T | — | 0.3 T | | 0 T | — | 0.3 T | 0.3 | 0.2 | Comparative Example |
| 2 | Type A | 0.08 T | 3 Hz | 0 T | Type A | 0 T | — | 0.3 T | 0.3 | 0.2 | Comparative Example |
| 3 | Type A | 0.08 T | 3 Hz | 0.3 T | Type A | 0 T | — | 0 T | 0.2 | 0.3 | Comparative Example |
| 4 | Type A | 0.08 T | 3 Hz | 0.3 T | Type A | 0 T | — | 0.3 T | 0.2 | 0.2 | Comparative Example |
| 5 | Type A | 0.08 T | 3 Hz | 0.3 T | Type A | 0.08 T | 3 Hz | 0.3 T | 0.2 | 0.1 | Comparative Example |
| 6 | Type B | 0.08 T | 3 Hz | 0.3 T | Type B | 0.08 T | 3 Hz | 0.3 T | 0.05 | 0.05 | Example |

What is claimed:

1. An apparatus for continuous casting of molten metals, the molten metal being continuously cast using a casting mold, said apparatus comprising:

electromagnets each comprising an iron core and a coil wound over said iron core, said electromagnets being arranged in a facing relation on opposite sides of said mold along a transverse width thereof to lie side by side along a longitudinal width of said mold; and a single-phase AC current power supply connected to each coil and structurally configured to supply a single-phase AC current to each coil such that every pair of the electromagnets lying side by side next to each other have a phase difference of 0° or 180°, wherein, said electromagnets arranged in a facing relation on opposite sides of said mold along a transverse width thereof to lie side by side along a longitudinal width of said mold comprise i) at least a first electromagnet on a first of said sides, a second electromagnet immediately adjacent the first electromagnet, and a third electromagnet immediately adjacent the second electromagnet, and ii) at least a fourth electromagnet on a second of said sides, a fifth electromagnet immediately adjacent the fourth electromagnet, and a sixth electromagnet immediately adjacent the fifth electromagnet, the first electromagnet is opposite the fourth electromagnet, the second electromagnet is opposite the fifth electromagnet, and the third electromagnet is opposite the sixth electromagnet, said single-phase AC current power supply is connected to each coil of said first through sixth electromagnet and configured to supply a single-phase AC current to each of said coils such that a phase difference between every coil and the immediately adjacent coil is 0° or 180°, and the coil of the first electromagnet and the coil of the fourth electromagnet are wound in the same first direction (x, x), the coil of the second electromagnet and the coil of the fifth electromagnet are wound in the same second direction (y, y), the first direction being opposite to the second direction, the coil of the third electromagnet and the coil of the sixth electromagnet are wound in the same first direction (x, x), the single-phase AC current supplied from said single-phase AC current power supply to each of the coils of said first through sixth electromagnets develops magnetic forces between every two electromagnets arranged adjacent to each other on the same side that are reversed in direction repeatedly over time to induce only vibrating flows (10) in a direction of longitudinal width of the mold.

2. An apparatus for continuous casting of molten metals, the molten metal being continuously cast using a casting mold, said apparatus comprising:

electromagnets each comprising an iron core and a coil wound over said iron core, said electromagnets being arranged in a facing relation on opposite sides of said mold along a transverse width thereof to lie side by side along a longitudinal width of said mold; and a single-phase AC current power supply connected to each coil and structurally configured to supply a single-phase AC current to each coil such that every pair of the electromagnets lying side by side next to each other have a phase difference of 0° or 180°, wherein, said electromagnets arranged in a facing relation on opposite sides of said mold along a transverse width thereof to lie side by side along a longitudinal width of said mold comprise i) at least a first electromagnet on a first of said sides, a second electromagnet immediately adjacent the first electromagnet, and a third electromagnet immediately adjacent the second electromagnet, and ii) at least a fourth electromagnet on a second of said sides, a fifth electromagnet immediately adjacent the fourth electromagnet, and a sixth electromagnet immediately adjacent the fifth electromagnet, the first electromagnet is opposite the fourth electromagnet, the second electromagnet is opposite the fifth electromagnet, and the third electromagnet is opposite the sixth electromagnet, said single-phase AC current power supply is connected to each coil of said first through sixth electromagnet and configured to supply a single-phase AC current to each of said coils such that a phase difference between every coil and the immediately adjacent coil is 0° or 180°, and the coils of the first through third electromagnets are wound in the same first direction (x, x, x), the coils of the fourth through sixth electromagnets are wound in the same second direction (y, y, y), the first direction being opposite to the second direction, the single-phase AC current supplied from said single-phase AC current power supply to each of the coils of said first through sixth electromagnets develops magnetic forces between every two electromagnets arranged opposite to each other on different sides of the mold that are reversed in direction repeatedly over time to induce only vibrating flows (20) in a direction transverse to a width of the mold.

* * * * *